US009290284B2

(12) United States Patent
Civolani et al.

(10) Patent No.: US 9,290,284 B2
(45) Date of Patent: Mar. 22, 2016

(54) PRODUCT WRAPPING MACHINE

(75) Inventors: Daniele Civolani, Molinella (IT); Marco Carrara, Stiore di Monteveglio (IT)

(73) Assignee: AZIONARIA COSTRUZIONI MACCHINE AUTOMATICHE A.C.M.A. S.p.A. (IT)

( * ) Notice: Subject to any disclaimer, the term of this patent is extended or adjusted under 35 U.S.C. 154(b) by 567 days.

(21) Appl. No.: 13/806,539

(22) PCT Filed: Jun. 13, 2011

(86) PCT No.: PCT/IB2011/052556

§ 371 (c)(1),
(2), (4) Date: Dec. 21, 2012

(87) PCT Pub. No.: WO2012/001563

PCT Pub. Date: Jan. 5, 2012

(65) Prior Publication Data

US 2013/0111850 A1 May 9, 2013

(30) Foreign Application Priority Data

Jun. 30, 2010 (IT) ..... BO2010A0421

(51) Int. Cl.
*B65B 11/32* (2006.01)
*B65B 25/00* (2006.01)
(Continued)

(52) U.S. Cl.
CPC ..... *B65B 11/32* (2013.01); *B65B 25/005* (2013.01); *B65B 49/12* (2013.01); *B65B 65/02* (2013.01)

(58) Field of Classification Search
CPC ..... B65B 65/04; B65B 65/02; B65B 49/14; B65B 49/12; B65B 25/005; B65B 11/36; B65B 11/34; B65B 11/32; B65B 11/30; B65B 11/28
USPC ..... 53/203, 220, 225, 234
See application file for complete search history.

(56) References Cited

U.S. PATENT DOCUMENTS 2,443,952 A * 6/1948 Gilbert ..... 53/234
3,890,766 A * 6/1975 Hatta ..... 53/234
(Continued)

FOREIGN PATENT DOCUMENTS

CN 1096164 12/1994
CN 1671542 9/2005
(Continued)

OTHER PUBLICATIONS

Chinese Office Action dated Dec. 4, 2013 from counterpart application 201180031947.3, 5 pages.
(Continued)

*Primary Examiner* — Stephen F Gerrity
(74) *Attorney, Agent, or Firm* — Timothy J. Klima; Shuttleworth & Ingersoll, PLC

(57) ABSTRACT

A product wrapping machine includes a feed mechanism by which products to be wrapped are directed on entry, in ordered succession, to a take-up station, a wrapping device including a first conveyor, rotatable continuously about a respective axis, a second conveyor rotatable intermittently about a respective axis, and a transfer device by which the products are gripped in succession at the take-up station and fed to the wrapping device. The first conveyor includes a plurality of carriers, mounted rotatably on it and equipped with gripper heads. Each carrier is associated with a respective motion-inducing device designed to move the carrier in such a way as to enable the carrier to interface and interact with a respective gripper element of the second conveyor.

20 Claims, 5 Drawing Sheets

(51) Int. Cl.
*B65B 49/12* (2006.01)
*B65B 65/02* (2006.01)

(56) References Cited

U.S. PATENT DOCUMENTS

| | | | | | |
|---|---|---|---|---|---|
| 4,006,577 | A | | 2/1977 | Schoppee | |
| 4,186,544 | A | * | 2/1980 | Johnson | 53/234 |
| 4,408,435 | A | | 10/1983 | Sutton | |
| 4,539,791 | A | | 9/1985 | Zamboni | |
| 4,999,970 | A | * | 3/1991 | Bamrungbhuet et al. | 53/225 |
| 5,003,755 | A | | 4/1991 | Draghetti | |
| 5,373,681 | A | * | 12/1994 | Shigeta | 53/225 |
| 5,477,661 | A | * | 12/1995 | Draghetti et al. | 53/234 |
| 5,490,368 | A | | 2/1996 | Spatafora | |
| 5,493,847 | A | | 2/1996 | Spatafora | |
| 5,771,666 | A | | 6/1998 | Bertuzzi et al. | |
| 6,050,060 | A | * | 4/2000 | Spatafora et al. | 53/447 |
| 6,070,387 | A | * | 6/2000 | Salicini | 53/234 |
| 6,141,944 | A | | 11/2000 | Spatafora | |
| 7,399,261 | B2 | | 7/2008 | Boldrini et al. | |
| 2003/0230048 | A1 | | 12/2003 | Salicini et al. | |
| 2007/0130888 | A1 | * | 6/2007 | Osti et al. | 53/234 |
| 2012/0090267 | A1 | * | 4/2012 | Van Rens | 53/203 |

FOREIGN PATENT DOCUMENTS

| | | | | | |
|---|---|---|---|---|---|
| DE | 19920710 | A1 | * | 11/2000 | B65B 11/28 |
| EP | 0553636 | | | 8/1993 | |
| EP | 0936163 | | | 8/1999 | |
| GB | 2164913 | A | * | 4/1986 | 53/234 |
| GB | 2277507 | A | * | 11/1994 | 53/234 |

OTHER PUBLICATIONS

International Search Report and Written Opinion dated Sep. 14, 2011 from related PCT application, PCT/IB2011/052556, 8 pages.

* cited by examiner

PRODUCT WRAPPING MACHINE

This application is the National Phase of International Application PCT/IB2011/052556 filed Jun. 13, 2011 which designated the U.S. and that International Application was published under PCT Article 21(2) in English.

This application claims priority to Italian Patent Application No. BO2010A000421 filed Jun. 30, 2010 and PCT Application No. PCT/IB2011/052556 filed Jun. 13, 2011, which applications are incorporated by reference herein.

TECHNICAL FIELD

This invention relates to a product wrapping machine.

This invention can be advantageously applied to the wrapping of food products such as, for instance, sweets, chocolates, bars of chocolate and the like to which this description will hereinafter refer but without thereby limiting the scope of the invention.

BACKGROUND ART

In prior art continuous wrapping machines, a transfer drum feeds chocolates in an ordered succession to a wrapping device.

The wrapping device comprises a first conveyor and a second conveyor, rotating continuously, tangent to each other at a transfer station and defining a wrapping path.

The first conveyor is designed to couple each product to a sheet of wrapping material and to fold the sheet partially around the product. Then, after the product has been transferred to the second conveyor, the sheet of wrapping material is folded around the product to form a tubular wrapping.

While the product is transported along its path by the second conveyor, the ends of the tubular wrapping are folded according to a predetermined wrapping style.

This is done by folding heads which operate downstream of the station where the product is transferred from the first conveyor to the second.

Machines of this type were originally intermittent, that is to say, the first and second conveyors rotated intermittently so as to allow the folding heads to perform certain operations during a stop.

Prior art intermittent machines have relatively low production speeds, however.

To overcome this disadvantage, machines designed to work with continuous motion were made, that is to say, machines where the first and second conveyors moved uninterruptedly.

In this configuration, the folding heads must therefore follow the product along its path and must be movable continuously and synchronized with the first and second conveyors.

This requires the use of mechanisms of considerable structural complexity and high cost.

DISCLOSURE OF THE INVENTION

The aim of this invention is to provide a product wrapping machine which overcomes the disadvantages of the prior art.

More specifically, this invention has for an aim to provide a product wrapping machine which is simple in construction and which allows costs to be limited but not at the expense of high productions speeds.

Another aim of the invention is to provide a machine that avoids synchronization problems while maintaining a high production speed.

This invention accordingly provides a product wrapping machine in accordance with what is claimed in one or more of the appended claims.

BRIEF DESCRIPTION OF THE DRAWINGS

The invention will now be described with reference to the accompany drawings which illustrate a preferred embodiment of it and in which.

DETAILED DESCRIPTION OF THE PREFERRED EMBODIMENTS OF THE INVENTION

Figure 1:
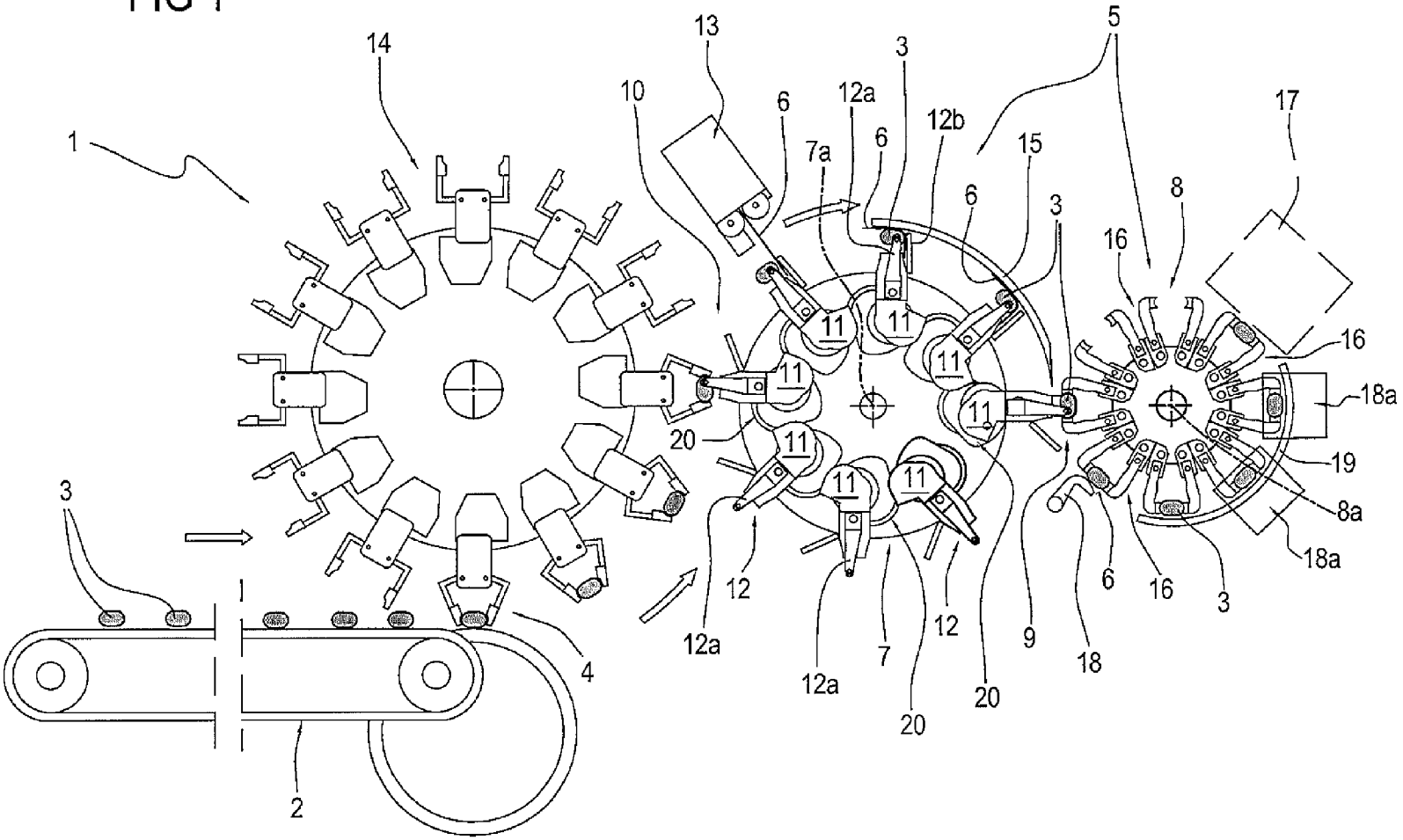
FIG. 1 is a schematic front view of the product wrapping machine according to this invention.

With reference to FIG. 1, the numeral 1 denotes in its entirety a product wrapping machine comprising feed means 2 by which products 3 to be wrapped, such as sweets, chocolates, bars of chocolate and the like, are directed on entry to a take-up station 4.

With reference to FIG. 1, the machine is equipped with a wrapping device 5 designed to couple each product 3 to a respective sheet of wrapping material 6 and to fold the sheet 6 around the product 3.

The wrapping device 5 comprises a first conveyor 7 for coupling each product 3 to a respective sheet of wrapping material 6, and a second conveyor 8 for folding the sheet of wrapping material 6 around the product 3. The first conveyor 7 and the second conveyor 8 are substantially tangent to each other at a transfer station 9.

The machine 1 also comprises a transfer device 14 by which the products 3 are picked up in succession from the feed means 2 at the take-up station 4 and fed to the first conveyor 7 at a further feed station 10.

The first conveyor 7 rotates about an axis 7*a* and comprises a plurality of carriers 11 designed to grip the products 3. Each carrier 11 comprises at least one gripper head 12, in turn comprising a gripper 12*a* which holds the product 3 as it travels between the feed station 10 and the transfer station 9. The gripper head 12 also comprises a retaining plate 12*b* which grips the sheet of wrapping material 6 taken up by a feed device 13 forming part of the machine 1 and located along the path between the feed station 10 and the transfer station 9.

As illustrated in FIG. 1, each carrier 11, after receiving the product 3 from the transfer device 14 at the feed station 10 and a respective sheet of wrapping material 6 from the feed device 13, interacts with a first folding means, corresponding to a first fixed tile 15 which faces the periphery of the first conveyor 7 and which is positioned upstream of the transfer station 9 to fold the sheet 6 into the shape of an L on the product 3.

The sheet 6 is then folded into a U shape around the respective product 3 when the product 3 is transferred from the first conveyor 7 to the second 8 at the transfer station 9.

The second conveyor 8 is equipped with a plurality of gripper elements 16, which hold the product 3, together with the sheet 6, as they travel from the transfer station 9 to an outfeed station 17.

The second conveyor 8 rotates intermittently about its axis of rotation 8*a*.

Downstream of the transfer station 9 there is a folding station 18 which, during the stop of the second conveyor 8, doubles the upstream flap of the sheet 6, onto the product 3, relative to the feed direction.

During the rotation of the second conveyor 8, the product 3 moves into contact with a second folding means consisting of a second, fixed tile 19 which faces and is coaxial with the second conveyor 8.

The tile 19 doubles the downstream flap of the sheet 6, relative to the feed direction, in such a way as to form a tubular wrapping around the product 3.

Along the tile 19 there are further folding heads 18*a* which fold the ends of the tubular wrapping, thereby completing the wrapping operation.

The interaction between the first conveyor 7, which moves continuously about its axis 7*a*, and the second conveyor 8, which moves intermittently about its axis 8*a*, at their point of substantial tangency, that is to say, at the transfer station 9, is made possible by a motion-inducing device 20 which each carrier 11 is equipped with.

Each motion-inducing device 20 is actuated only by the continuous rotation of the first conveyor 7 and is designed to apply to each carrier 11 a law of motion whereby the carrier 11 driven in rotation continuously by the first conveyor 7, is able to interface and interact with a respective gripper element 16 located on the second conveyor 8 and intermittently driven by the selfsame second conveyor 8.

Figure 3A:
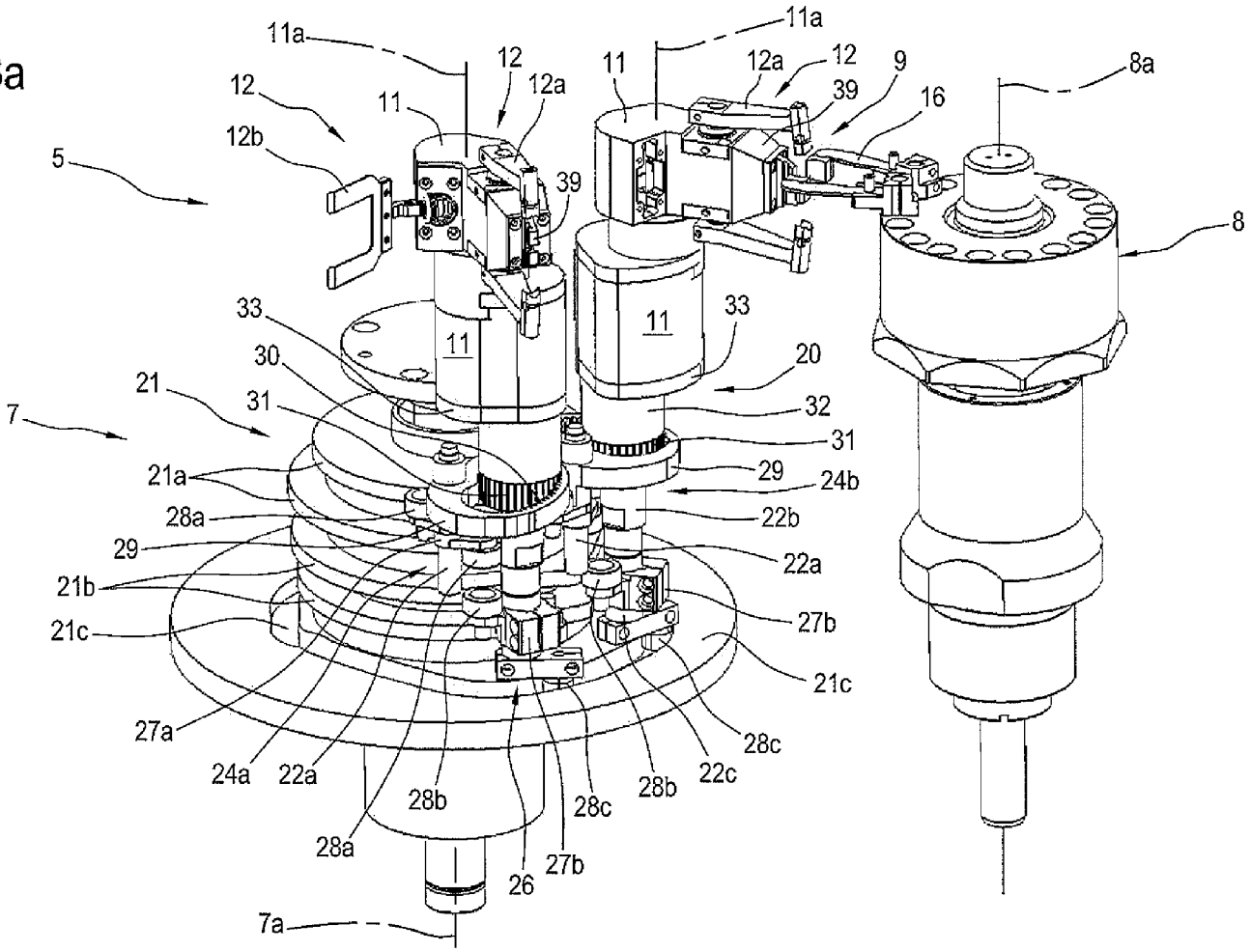
FIG. 3*a* is a first perspective view, with some parts cut away in order to better illustrate others, of the machine portion FIG. 2.
Figure 3B:
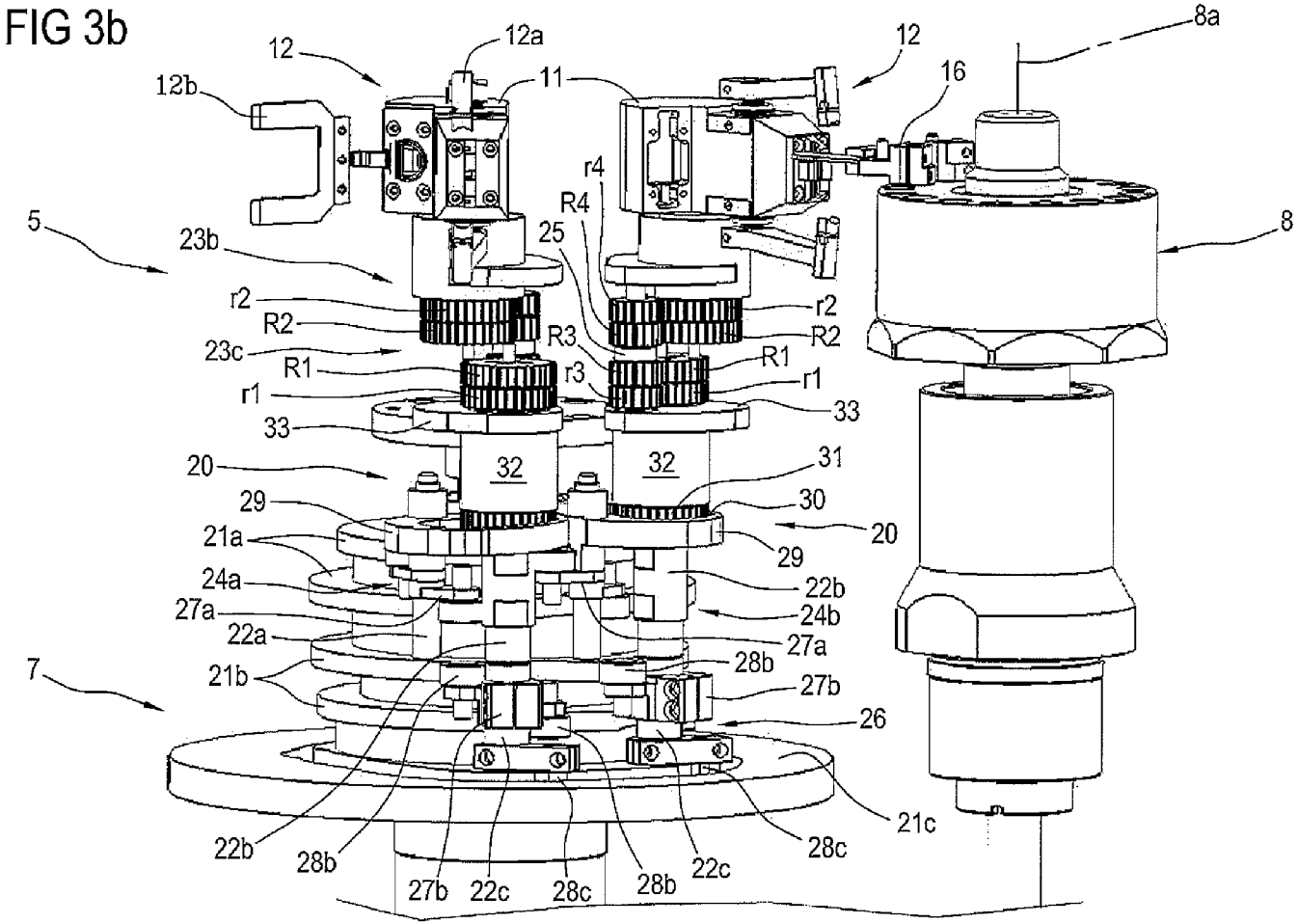
FIG. 3*b* is a second perspective view, with some parts cut away in order to better illustrate others, of the machine portion FIG. 2.

As illustrated in FIGS. 3*a* and 3*b*, each motion-inducing device 20 applies that law of motion thanks to a plurality of fixed conjugate cams 21*a*, 21*b*, 21*c* which are stacked on each other and coaxial with the axis 7*a* of the conveyor 7.

In other words, the law of motion derives from the combination of at least two distinct, independent motions.

Each motion-inducing device 20 comprises a plurality of cam follower elements 28*a*, 28*b*, 28*c* and a plurality of motion-transmitting shafts 22*a*, 22*b*, 22*c*, having axes parallel to the axis 7*a* of rotation of the first conveyor 7 and being connected both to the respective cam follower elements or rollers 28*a*, 28*b*, 28*c*, which guide the roto-translational movements of each motion-transmitting shaft 22*a*, 22*b*, 22*c* and to the related carrier 11, to which motion is transmitted via a plurality of gears 31, 23*b*, 23*c*.

More specifically, each motion-inducing device 20 comprises at least one first mechanism 24*a* and at least one second mechanism 24*b* by which motion is induced in each carrier 11 and at least one mechanism 26 driving the gripper heads 12 of each carrier 11.

Figure 2:
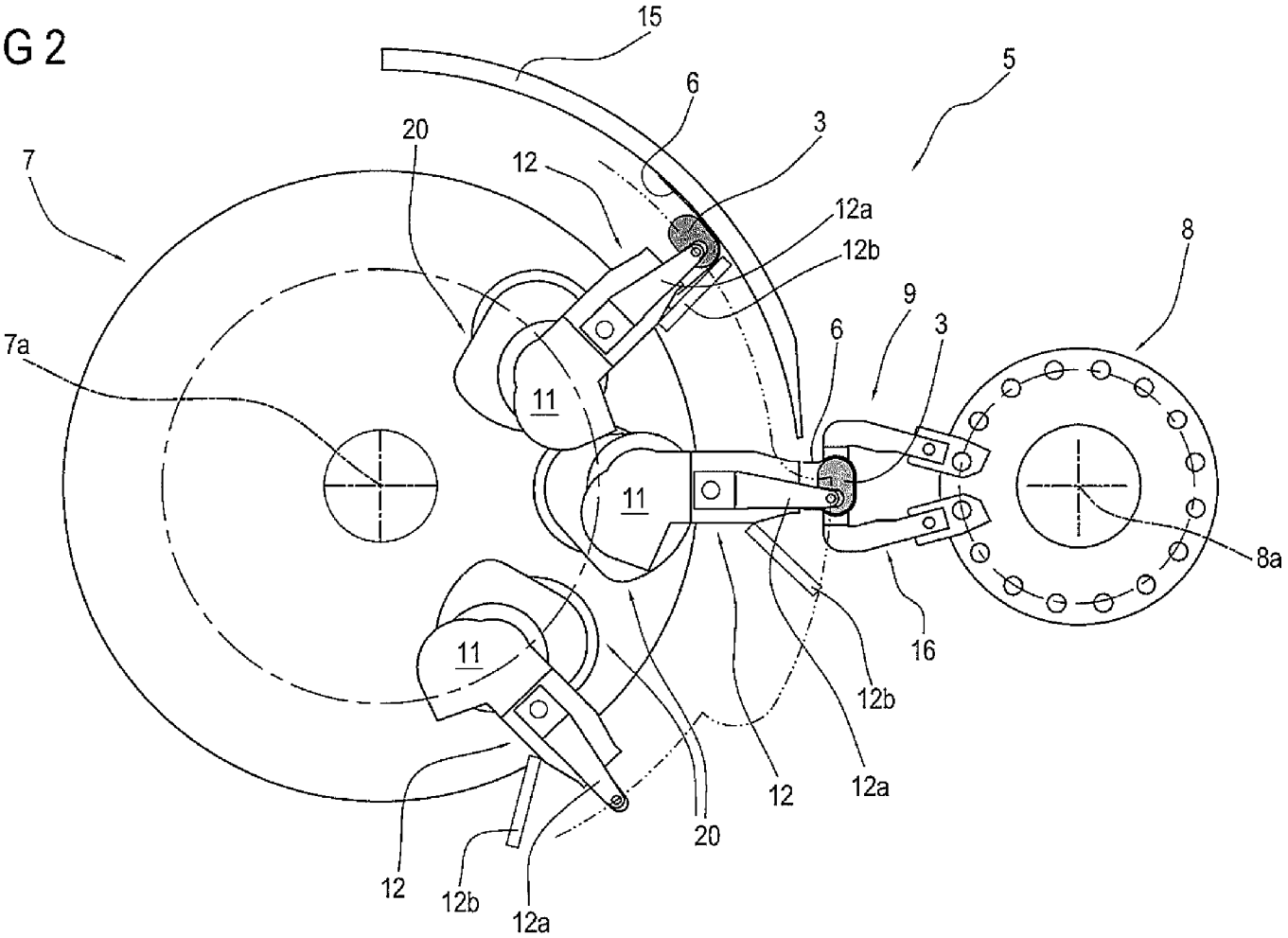
FIG. 2 is a schematic front view of a portion of the machine illustrated in FIG. 1, with some parts cut away for clarity.

The first motion-inducing mechanism 24*a* causes displacement of the entire carrier 11 in a radial direction along an arcuate segment P1 (see FIG. 2)

The second motion-inducing mechanism 24*b*, on the other hand, causes rotation of the carrier 11 about its axis of rotation 11*a*.

Lastly, the mechanism 26 causes the gripper heads 12 to open and close.

FIGS. 3*a* and 3*b*, in which the guards covering the outside of the machine are cut away, illustrate the internal structure of the machine in more detail. Each motion-inducing mechanism 24*a* and 24*b* of the carrier 11 interacts with a respective pair of conjugate cams 21*a*, 21*b* and has a motion-transmitting shaft 22*a*, 22*b* connected to a rocker 27*a*, 27*b* equipped with cam follower elements embodied by two cam following rollers 28*a*, 28*b* which ride the profile presented by a respective cam 21*a*, 21*b* to form a desmodromic linkage.

The first mechanism 24*a* comprises a ring 29 of oblong shape presenting an internal toothed sector 30 with which a first gear 31 meshes.

The first gear 31 is connected rigidly by way of a sleeve member 32 to a plate 33 eccentrically supporting the respective carrier 11 to which motion is transmitted.

The ring 29 is in turn connected rigidly to the motion-transmitting shaft 22*a* of the first motion-inducing mechanism 24*a*. The rotation of the first conveyor 7 causes the cam follower rollers 28*a* to ride the profile of the conjugate cams 21*a*, thereby causing oscillation of the respective rocker 27*a*, which is rigidly connected to the motion-transmitting shaft 22*a*.

The rotation of the shaft 22*a* determines the rotation of the ring 29 and hence of the first gear 31 which meshes with the toothed sector 30 of the ring 29. The rotation of the gear 31 causes the rotation of the plate 33 which is rigidly connected to it through the sleeve member 32. Thus, movement is also imparted to the carrier 11, which is mounted eccentrically on the plate 33 and is made to move reciprocatingly towards the inside and outside of the first conveyor 7.

In other words, the carrier 11 is moved radially towards and away from the axis 7*a* along the arcuate segment P1, according to the angular position of the motion-inducing device 20 along the circular path of the first conveyor 7.

The second motion-inducing mechanism 24*b* comprises a plurality of gears 23*b* which connect the motion-transmitting shaft 22*b* to the respective carrier 11 and transmitting to the latter its rotary motion (see FIG. 3*b*).

The plurality of gears 23*b* comprises a first main wheel r1 keyed to the motion-transmitting shaft 22*b*, a second main wheel r2 associated rigidly with the respective carrier 11, and two secondary wheels r3, r4 which are keyed to a single secondary shaft 25 with an axis parallel to the axis of the motion-transmitting shaft 22*b*, and which mesh with the respective main wheel r1 and r2, in such a way as to transmit rotation from the first main wheel r1 to the second main wheel r2 and set the carrier 11 in rotation.

More in detail, the rotation of the first conveyor 7 causes the cam follower rollers 28*b* to ride the profile of the conjugate cams 21*b*.

The movement of the two cam follower rollers 28*b* causes oscillation of the respective rocker 27*b* which is rigidly connected to the motion-transmitting shaft 22*b*.

The rotation of the shaft 22*b* causes the rotation of the first main gear wheel r1 which transmits rotation to the second main wheel r2 via the two secondary wheels r3 and r4, which rotate at the same angular speed.

The second main gear wheel r2 is coaxial with the body of the carrier 11, causing the latter to rotate about its axis of rotation 11*a*.

The motion-transmitting shaft 22*b* of the motion-inducing device 24*b* is coaxial with, and internal of, the sleeve member 32 of the first motion-inducing mechanism 24*a*.

The combination of the two movements imparted to each carrier 11 by the first motion-inducing mechanism 24*a* and by the second motion-inducing mechanism 24*b* determines the complex movement of each carrier 11, transported in rotation about the axis 7*a* of the first conveyor 7 moving at a constant speed in such a way that the carrier can interface with the respective gripper element 16 which is mounted directly on the second conveyor 8 and which, together with the second conveyor 8, starts and stops intermittently.

The carrier moves radially outwards relative to the axis 7*a*, to remain at the transfer station 9 and to allow the half-wrapped product 3 to be passed on to the respective gripper element 16.

Further, the resulting movement causes a temporary slowing and/or stopping only of the carrier 11 at the point of substantial tangency between the first conveyor 7 and the second 8, at the station 9, and allows the carrier 11 to interface the respective gripper element 16.

Thus, the first conveyor 7 and the second conveyor 8 interact with each although they rotate according to different laws of motion.

In conclusion, the mechanisms 24*a* and 24*b* cause the gripper heads 12 to move closer to the gripper elements 16 and cancel the relative speed between them upon transfer of the products 3.

The gripper heads 12 of each carrier 11 are driven by the respective mechanism 26 which drives the device 20.

Figure 4:
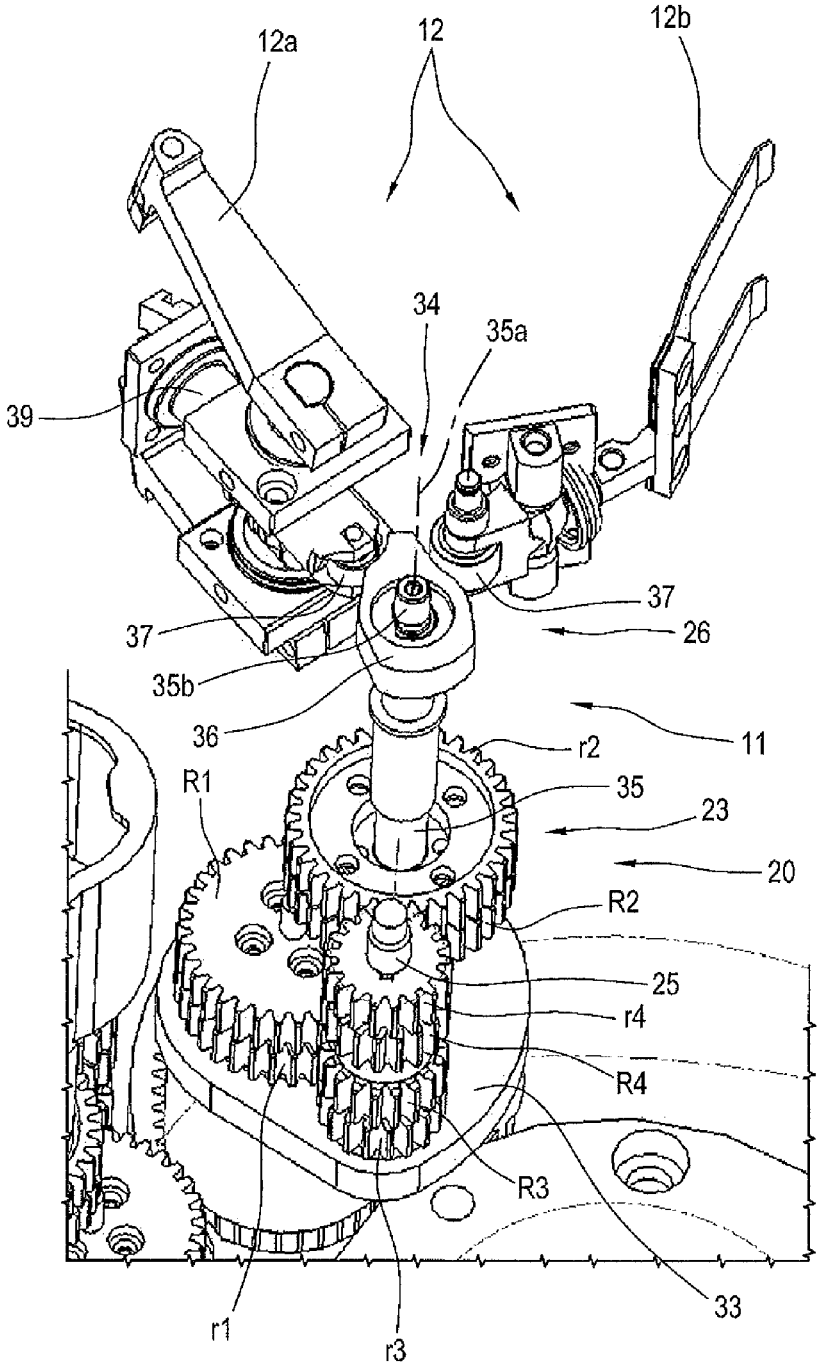
FIG. 4 is a third perspective view of the machine according to the invention, with some parts cut away in order to better illustrate the internal structure.

Each drive mechanism 26, for opening and closing the gripper heads 12, comprises a motion-transmitting shaft 22*c* connected via a plurality of gears 23*c* to a drive component 34 located internally of each carrier 11 and operating the respective heads 12 (as shown in FIG. 4, where the external guards of the carrier is cut away to better illustrate its internal structure).

The motion-transmitting shaft 22*c* is connected to a tappet consisting of a cam follower roller 28*c* riding internally of a cam 21*c* (see FIG. 3*b*).

The drive component 34 operating on each gripper head 12 comprises a drive rod 35 of which a first end 35*b* is furnished with a cam member 36 designed to interact with two following rollers 37 connected to the gripper 12*a* and to the retaining plate 12*b* of the gripper head 12 and determining their movement.

The motion is transmitted from the shaft 22*c* to the rod 35 via the gears 23*c* which comprise a first main wheel R1 keyed to the motion-transmitting shaft 22*c*, a second main wheel R2 keyed to a second end of the drive rod 35, and two secondary wheels R3, R4, keyed to a hollow shaft turning idle and coaxially with a secondary shaft 25, meshing with the first main wheel R1 and with the second main wheel R2, respectively, in such a way as to set the rod 35 in rotation.

The rotation of the rod 35 causes the cam member 36 to oscillate about the axis 35*a* of the rod 35 so that the cam member interacts with the two follower rollers 37, thereby alternately opening or closing the grippers 12*a* and opening or closing the retaining plate 12*b*.

As shown in FIG. 3*b*, to keep the structure of the motion-inducing device 20 compact, the drive rod 35 is coaxial with and internal of the motion-transmitting shaft 22*b* of the second motion-inducing mechanism 24*b*, the shaft being hollow. As stated, the motion-transmitting shaft 22*b* of the motion-inducing mechanism 24*b* is in turn coaxial with, and internal of, the sleeve member 32 of the first motion-inducing mechanism 24*a*.

The cam follower roller 37, which drives the gripper 12*a*, is connected to a pusher arm 39 which is pushed radially outwards to facilitate releasing of the product 3. The body of the pusher arm 39 has a variable cross section and slides between the two jaws of the gripper 12*a*, causing them to open and close, as shown in FIG. 4.

Thus, when the cam member 36 of the drive mechanism 26 interacts with the cam follower roller 37, it causes the pusher arm 39 to advance towards the gripper element 16 of the second conveyor 8.

During its translational movement, the pusher arm 39 separates the jaws of the gripper 12 which open and release the product 3 so it is transferred between the jaws of the gripper element 16 of the second conveyor 8. At the same time, the pusher arm 39 contributes to keeping the product 3 in the correct position to facilitate its transfer from the first conveyor 7 to the second conveyor 8.

The invention described above brings important advantages and achieves the above mentioned aims.

The structure of the first conveyor, cams and motion-inducing device very compact so as to occupy less space.

In effect, the cam pairs 21*a* and 21*b* and the cam 21, which controls the gripper head drive mechanism, are coaxial with the axis of rotation of the first conveyor 7.

The motion-inducing device also has stacked gears which interact with each other to set the respective end elements in motion.

The combination of the two movements allows the carrier to remain at the transfer station and to interact with the respective gripper element of the second conveyor, in synchrony with the moments the latter stops.

This simplifies the folding operation at the ends of the products 3 performed by the folding heads 18*a* located along the path of the second conveyor 8 during the stops in its intermittent motion.

The costs are considerably limited and since the machine operates intermittently only at the final stage of folding, its production speed is high compared to prior art intermittent machines.

The invention claimed is:

1. A product wrapping machine comprising:

a feed conveyor by which products to be wrapped are directed on entry, in ordered succession, to a take-up station;

a wrapping device comprising a first conveyor and a second conveyor;

wherein the first conveyor moves continuously and comprises a plurality of carriers each including at least one gripper head;

wherein the second conveyor moves intermittently and comprises a plurality of gripper elements;

a plurality of motion-inducing devices, one each connected to each carrier for moving the carrier with respect to the first conveyor to interface and interact with a respective gripper element of the second conveyor to directly transfer a product from the carrier to the respective gripper.

2. The machined as in claim 1, wherein the first conveyor comprises a plurality of stacked cams operating in conjunction with each of the motion-inducing devices.

3. The machine as in claim 2, wherein the first conveyor rotates on an axis of rotation, wherein each motion-inducing device comprises a plurality of cam follower elements and a plurality of rotatable motion-transmitting shafts having axes parallel to an axis of rotation of the first conveyor and being connected both to the respective cam follower elements, which guide the movements of each motion-transmitting shaft, and to the related carrier, to which motion is transmitted via a plurality of gears.

4. The machine as in claim 1, wherein each motion-inducing device comprises at least one first motion-inducing mechanism and at least one second motion-inducing mechanism by which motion is induced in each carrier, and at least one mechanism driving the gripper heads of each carrier.

5. The machine as in claim 4, wherein each motion-inducing mechanism operates in conjunction with a respective pair of cams and includes a rocker including two following rollers riding a profile of one respective cam of the pair and a motion-transmitting shaft connected to the rocker; the rocker, the following rollers and the pair of cams combining to establish a desmodromic linkage.

6. The machine as in claim 5, wherein the first motion-inducing mechanism displaces an axis of rotation of the carrier in a radial direction and comprises a ring of oblong shape including an internal toothed sector, and a first gear meshing with the ring; the ring being connected rigidly to the motion-transmitting shaft of the first motion-inducing mechanism.

7. The machine as in claim 6, and further comprising a sleeve member and a plate eccentrically supporting the carrier to which motion is transmitted, wherein the first gear is connected rigidly by the sleeve member to the plate.

8. The machine as in claim 5, wherein the second motion-inducing mechanism causes the carrier to turn on the axis of rotation of the carrier, and comprises a plurality of gears connecting the motion-transmitting shaft of the second motion-inducing mechanism to the respective carrier and transmitting a rotary motion of the motion-transmitting shaft of the second motion-inducing mechanism to the carrier.

9. The machine as in claim 8, wherein the second motion-inducing mechanism comprises a first main wheel keyed to the motion-transmitting shaft of the second motion-inducing mechanism, a second main wheel associated rigidly with the respective carrier, and two secondary wheels keyed to a single secondary shaft, meshing with the first main wheel and with the second main wheel, respectively, to transmit rotation from the first main wheel to the second main wheel and cause the carrier to turn on an axis of rotation of the carrier.

10. The machine as in claim 4, wherein the mechanism driving the gripper heads of each carrier comprises a motion-transmitting shaft connected via a plurality of gears to a drive component located internally of each carrier and operating the respective heads.

11. The machine as in claim 10, wherein the motion-transmitting shaft of the mechanism driving the gripper heads is connected to a following roller riding internally of a hollow cam.

12. The machine as in claim 10, wherein the drive component operating the gripper heads comprises a drive rod including a first end with a cam member for engaging following rollers connected to the gripper heads and determining movement of the gripper heads.

13. The machine as in claim 12, wherein the plurality of gears comprises a first main wheel keyed to the motion-transmitting shaft of the mechanism driving the gripper heads, a second main wheel keyed to a second end of the drive rod, and two secondary wheels, keyed to a hollow shaft turning idle and coaxially with a secondary shaft, meshing with the first main wheel and with the second main wheel, respectively, to set the rod in rotation.

14. The machine as in claim 1, wherein each motion-inducing device includes a first motion-inducing mechanism including at least one cam and one follower engaging the cam to cause displacement of the carrier in a radial direction along an arcuate segment of the first conveyor and a second motion-inducing mechanism including at least one cam and one follower engaging the cam to cause rotation of the carrier about an axis of rotation of the carrier.

15. A product wrapping machine comprising:

a feed conveyor by which products to be wrapped are directed on entry, in ordered succession, to a take-up station;

a wrapping device comprising a first conveyor and a second conveyor;

wherein the first conveyor moves continuously and comprises a plurality of carriers each including at least one gripper head;

wherein the second conveyor moves intermittently and comprises a plurality of gripper elements;

a plurality of motion-inducing devices, one each connected to each carrier for moving the carrier to interface and interact with a respective gripper element of the second conveyor;

wherein the first conveyor comprises a plurality of stacked cams operating in conjunction with each of the motion-inducing devices.

16. The machine as in claim 15, wherein the first conveyor rotates on an axis of rotation, wherein each motion-inducing device comprises a plurality of cam follower elements and a plurality of rotatable motion-transmitting shafts having axes parallel to an axis of rotation of the first conveyor and being connected both to the respective cam follower elements, which guide the movements of each motion-transmitting shaft, and to the related carrier, to which motion is transmitted via a plurality of gears.

17. A product wrapping machine comprising:

a feed conveyor by which products to be wrapped are directed on entry, in ordered succession, to a take-up station;

a wrapping device comprising a first conveyor and a second conveyor;

wherein the first conveyor moves continuously and comprises a plurality of carriers each including at least one gripper head;

wherein the second conveyor moves intermittently and comprises a plurality of gripper elements;

a plurality of motion-inducing devices, one each connected to each carrier for moving the carrier to interface and interact with a respective gripper element of the second conveyor;

wherein each motion-inducing device comprises at least one motion-inducing mechanism by which motion is induced in each carrier, wherein each motion-inducing mechanism operates in conjunction with a respective pair of cams and includes a rocker including two following rollers riding a profile of one respective cam of the pair and a motion-transmitting shaft connected to the rocker; the rocker, the following rollers and the pair of cams combining to establish a desmodromic linkage.

18. The machine as in claim 17, wherein the at least one motion-inducing mechanism includes a first motion-inducing mechanism that displaces an axis of rotation of the carrier in a radial direction and comprises a ring of oblong shape including an internal toothed sector, and a first gear meshing with the ring; the ring being connected rigidly to the motion-transmitting shaft of the first motion-inducing mechanism.

19. The machine as in claim 18, wherein the at least one motion-inducing mechanism includes a second motion-inducing mechanism that causes the carrier to turn on the axis of rotation of the carrier, and comprises a plurality of gears connecting the motion-transmitting shaft of the second motion-inducing mechanism to the respective carrier and transmitting a rotary motion of the motion-transmitting shaft of the second motion-inducing mechanism to the carrier.

20. The machine as in claim 19, wherein the second motion-inducing mechanism comprises a first main wheel keyed to the motion-transmitting shaft of the second motion-inducing mechanism, a second main wheel associated rigidly with the respective carrier, and two secondary wheels keyed to a single secondary shaft, meshing with the first main wheel and with the second main wheel, respectively, to transmit rotation from the first main wheel to the second main wheel and cause the carrier to turn on an axis of rotation of the carrier.

* * * * *